United States Patent [19]

Konishi et al.

[11] 4,071,585

[45] Jan. 31, 1978

[54] VARIABLE VENTURI TYPE CARBURETOR

[75] Inventors: Masami Konishi, Toyota; Norihiko Nakamura, Mishima; Takaaki Itou; Kazuo Kikuchi, both of Susono, all of Japan

[73] Assignees: Toyota Jidosha Kogyo Kabushiki Kaisha; Aisan Industry Company, Limited, both of Japan

[21] Appl. No.: 782,394

[22] Filed: Mar. 29, 1977

[30] Foreign Application Priority Data

Dec. 29, 1976 Japan ..... 51-15947

[51] Int. Cl.[2] ..... F02M 1/10

[52] U.S. Cl. ..... 261/36 A; 261/39 A; 261/44 R; 261/121 B; 261/DIG. 75; 261/DIG. 74; 123/179 G

[58] Field of Search ..... 261/36 A, 44 R, 121 B, 261/39 A, DIG. 74, DIG. 75; 123/179 G

[56] References Cited

U.S. PATENT DOCUMENTS

| | | | |
|---|---|---|---|
| 1,972,374 | 9/1934 | Brannigan | 261/36 A |
| 2,136,959 | 11/1938 | Winfield | 261/36 A |
| 3,125,084 | 3/1964 | Hall | 261/DIG. 74 |
| 3,258,254 | 6/1966 | Jakob | 261/36 A |
| 3,307,837 | 3/1967 | Winkler | 261/44 R |
| 3,587,543 | 6/1971 | Sulich | 261/36 A |
| 3,764,120 | 10/1973 | Imai | 261/121 B |
| 4,018,856 | 4/1977 | Hamakawa et al. | 261/39 A |

FOREIGN PATENT DOCUMENTS

| | | | |
|---|---|---|---|
| 881,580 | 11/1961 | United Kingdom | 261/36 A |
| 694,918 | 7/1953 | United Kingdom | 261/DIG. 74 |

*Primary Examiner*—Tim R. Miles

*Attorney, Agent, or Firm*—Stevens, Davis, Miller & Mosher

[57] ABSTRACT

Disclosed is a variable venturi type carburetor comprising a movable suction piston. The suction piston has a needle entering into a stationary jet. The needle and the jet defines an annular opening through which the fuel is injected into the intake passage formed in the carburetor. The fuel recirculating pump is connected to the fuel tank via the fuel recirculating passage. A restricted opening is formed in the fuel recirculating passage for forming a vacuum zone in the fuel recirculating passage located between the fuel recirculating pump and the restricted opening. The vacuum zone is connected to the jet.

17 Claims, 7 Drawing Figures

VARIABLE VENTURI TYPE CARBURETOR

DESCRIPTION OF THE INVENTION

The present invention relates to a carburetor, and particularly relates to a variable venturi type carburetor which has a needle fixed to a movable piston, and a fuel injecting jet in an intake passage formed in the carburetor. The needle enters into the fuel injected jet which is arranged so as to face the needle.

In a variable venturi type carburetor, the cross-sectional area of the venturi is varied in accordance with the change in the amount of air fed into the cylinder of the engine. The cross-sectional area is controlled so that the velocity of air flowing in the venturi, that is, the vacuum level in the venturi is always maintained at a constant value. In a carburetor of this type, in order to inject into the venturi an amount of fuel proportional to the amount of air flowing in the venturi, a movable needle and a stationary fuel injecting jet are used. The metering operation of the fuel injected from the jet into the air flowing in the venturi is effected in such a way that the annular opening area formed between the outer wall of the needle and the inner wall of the jet is varied.

In a conventional variable venturi type carburetor, since the pressure in the float chamber is maintained at atmospheric pressure, the pressure of the fuel in the fuel passage communicating the float chamber with the jet is always equal to the atmospheric pressure. As a result of this, a constant pressure difference is always created between the vacuum in the venturi and the pressure in the fuel passage and, thus, fuel is injected from the jet due to the above-mentioned constant pressure difference. As mentioned above, since the pressure difference between the vacuum in the venturi and the pressure in the fuel passage is always maintained at a constant value, the metering operation of the fuel injected from the jet into the air flowing in the venturi is effected in such a manner that the annular opening area formed between the needle and the jet is varied. In a conventional carburetor of this type, since it is necessary to select the sizes of the needle and the jet so that the annular opening formed between the outer wall of the needle and the inner wall of the jet has an extremely small area, irregularity in the accuracy of the size of the manufactured needle and jet, wear of the needle and the jet, and changes in temperature of the fuel have a great influence on the amount of fuel injected from the jet. Consequently, in a conventional variable venturi type carburetor in which the metering operation of the fuel containing no bubbles of air therein is effected, it is very difficult to accurately meter the fuel injected from the jet.

In addition, in general at the time of the starting operation and the warm-up of the engine, and when the engine is operating under a heavy load, it is necessary to feed a rich air-fuel mixture into the cylinder of the engine. Contrary to this, when the density of air introduced into the cylinder of the engine is relatively low, as in the case wherein the temperature in the engine compartment becomes excessively high and wherein a vehicle is driven at high elevations it is necessary to reduce the amount of fuel fed into the cylinder from the carburetor. In order to feed a rich air-fuel mixture into the cylinder of the engine at the time of the warm-up of the engine, a majority of the conventional variable venturi type carburetors are provided with a choke mechanism. However, since the choke valve of the choke mechanism is operated via a complicated link mechanism, if the choke mechanism is used for a long time, wear of the link mechanism causes inaccurate operation of the choke valve. In addition, irregularity in the accuracy of the size of the manufactured choke mechanism also causes inaccurate operation of the choke valve. If such inaccurate operation occurs and the amount of the fuel fed into the cylinder is increased at the time of the warm-up by using the choke mechanism, reduction in the accuracy of the metering operation of the fuel is caused. This results in an increase in the amount of harmful HC and CO components in the exhaust gas at the time of the warm-up of the engine and an increase in the fuel consumption.

An object of the present invention is to provide a variable venturi type carburetor capable of accurately metering the fuel by increasing the annular opening area formed between the needle and the jet.

Another object of the present invention is to provide a variable venturi type carburetor capable of increasing the amount of fuel fed into the cylinder at the time of the starting operation and the warm-up of the engine, and when the engine is operating under a heavy load, and also, capable of reducing the amount of fuel fed into the cylinder when the temperature in the engine compartment becomes excessively high and when a vehicle is driven at high elevations.

A further object of the present invention is to provide a variable venturi type carburetor which needs no choke mechanism.

According to the present invention, there is provided a variable venturi type carburetor, comprising:

- a housing;
- a bore extending through said housing and having an inner wall defining an intake passage;
- a suction piston movably mounted in said housing and having a bottom end face projecting into said intake passage, said bottom end face of said suction piston and said inner wall of said intake passage defining a venturi, said suction piston moving up and down in response to a change in the vacuum produced in said intake passage downstream of said venturi for maintaining the velocity of air flowing into said venturi at a constant value;
- a jet disposed on the inner wall of said intake passage at a position facing said bottom end face of said suction piston;
- a needle fixed onto said bottom end face of said suction piston and entering into said jet, said jet and said needle defining an annular opening through which fuel is injected into said intake passage;
- a fuel reservoir;
- a fuel recirculating pump having a suction side;
- a fuel recirculating passage communicating said fuel reservoir with the suction side of said fuel recirculating pump;
- a resticted opening disposed in said fuel recirculating passage for forming a vacuum zone in said fuel recirculating passage located between said restricted opening and the suction side of said fuel recirculating passage, and;
- a fuel supply passage communicating said vacuum zone with said jet.

DESCRIPTION OF PREFERRED EMBODIMENTS

Figure 1:
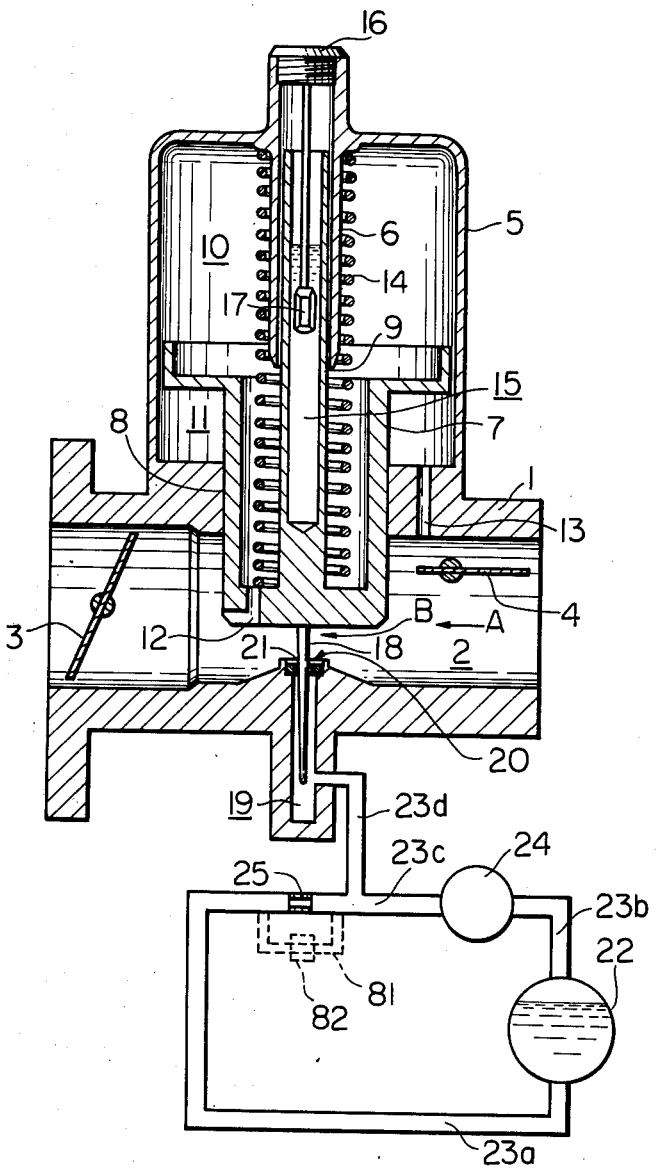
FIG. 1 is a cross-sectional side view of an embodiment of a variable venturi type carburetor according to the present invention.

Referring to FIG. 1, 1 designates a carburetor body, 2 an intake passage formed in the carburetor body 1, 3 a throttle valve and 4 a choke valve. The introduced air flows in the intake passage 2 in the direction shown by the arrow A. Reference numeral 5 designates an outer casing which has a hollow cylindrical guide 6 extending downwards in the central portion of the inside of the outer casing 5. Reference numeral 7 designates a suction piston which is slidably inserted into a guide hole 8 formed in the carburetor body 1 and is guided by the guide hole 8. In addition, the suction piston 7 has a suction piston rod 9 extending upwards. This suction piston rod 9 is slidably inserted into the hollow cylindrical guide 6 and is guided by the guide 6. A vacuum chamber 10 and an atmospheric pressure chamber 11, which are separated by the suction piston 7, are formed in the outer casing 5. The vacuum chamber 10 is connected to the intake passage 2 downstream of the venturi portion B via a suction hole 12; thus, a vacuum is produced in the vacuum chamber 10. On the other hand, the atmospheric pressure chamber 11 is connected to the intake passage 2 upstream of the venturi portion B via an air hole 13; thus the pressure in the atmospheric pressure chamber 11 is maintained at approximately atmospheric pressure. A compression spring 14 is disposed between the suction piston 7 and the outer casing 5. The suction piston 7 is always biased downwards due to the spring force of the compression spring 14. The inside of the suction piston rod 9 is filled with oil 15, and a damper 17 fixed to an oil cap nut 16 is dipped in the oil 15. A needle 18 extending downwards is rigidly fixed onto the lower end of the suction piston 7 and has a cross-sectional area which gradually decreases downwards. A fuel storing chamber 19 filled with fuel is formed in the carburetor body 1. A fuel injecting jet 20 opening into the intake passage 2 is formed in the upper end of the fuel storing chamber 19. When the needle 18 moves up and down, the annular opening area 21 formed between the needle 18 and the jet 20 is accordingly changed.

According to the present invention, there is provided a fuel recirculating pump 24 for sucking the fuel stored in a fuel tank 22 via a fuel recirculating conduit 23*a* and for returning the fuel to the fuel tank 22 via a fuel recirculating conduit 23*b*. In addition, a restricted opening 25 is formed in the fuel recirculating conduit 23*a* communicating the fuel tank 22 with the suction side of the fuel recirculating pump 24. In the case wherein the amount of the fuel recirculated in the fuel recirculating conduits 23*a* and 23*b* by the fuel recirculating pump 24 is considerably larger than that of the fuel injected from the jet 20, it is necessary to use a fuel recirculating pump, which is driven by an electrical motor always rotating at a constant speed, as the fuel recirculating pump 24. By using such a fuel recirculating pump, the fuel existing in a fuel recirculating conduit 23*c*, located downstream of the restricted opening 25, is always maintained at a constant vacuum level. Contrary to this, a fuel recirculating pump driven by the engine can be used as the fuel recirculating pump 24. In this case, the amount of the fuel recirculated by the fuel recirculating pump 24 is increased as the number of revolutions per minute of the engine is increased. Consequently, the vacuum level of the fuel flowing in the fuel recirculating conduit 23*c* is increased in accordance with an increase in the engine speed. Thus, in order to maintain the fuel in the fuel recirculating conduit 23*c* at a constant vacuum level, as is shown by the broken line in FIG. 1, it is necessary to provide a bypass 81 connecting the upstream side of the restricted opening 25 with the downstream side of the restricted opening 25, and to also provide in the bypass 81 a pressure regulating valve 82 which is opened when the pressure difference between the pressure in the fuel recirculating conduit 23*a* located upstream of the restricted opening 25 and the vacuum in the fuel recirculating conduit 23*c* located downstream of the restricted opening 25 is increased beyond a predetermined level. The fuel recirculating conduit 23*c* located downstream of the restricted opening 25 is connected to the fuel storing chamber 19, and, thus, the fuel in the fuel storing chamber 19 is always maintained at a constant vacuum level.

As is known to those skilled in the art, the suction piston 7 moves up and down due to the difference between the pressure in the atmospheric pressure chamber 11 and the vacuum in the vacuum chamber 10, and the cross-sectional area of the venturi portion B is varied so that the velocity of air flowing in the venturi portion B is maintained at an approximately constant value. Since the velocity of air flowing in the venturi portion B is always maintained at a constant value independent of the amount of air flowing in the venturi portion B, a vacuum of a constant level, for example −100 mmAq is always produced in the venturi portion B. Consequently, if the pressure in the float chamber 23 is maintained at atmospheric pressure, as in a conventional carburetor, the pressure in the fuel storing chamber 19 is equal to the atmospheric pressure and, as a result, fuel is injected into the intake passage 2 from the jet 20 due to the difference in the pressure of approximately +100 mmAq created between the vacuum in the venturi portion B and the vacuum in the fuel storing chamber 19. Contrary to this, in the present invention, the opening area of the restricted opening 25 is set so that the vacuum level in the fuel recirculating conduit 23*c* located downstream of the restricted opening 25 is equal to approximately −90 mmAq. Consequently, the difference between a vacuum in the venturi portion B and a vacuum in the fuel storing chamber 19 is equal to approximately 10 mmAq; thus, in order to inject into the intake passage 2 the same amount of fuel as that in a conventional carburetor, it is necessary to increase the annular opening area formed between the needle 18 and the jet 20 compared with that in the conventional case wherein the pressure in the float chamber 23 is maintained at atmospheric pressure.

Figure 2:
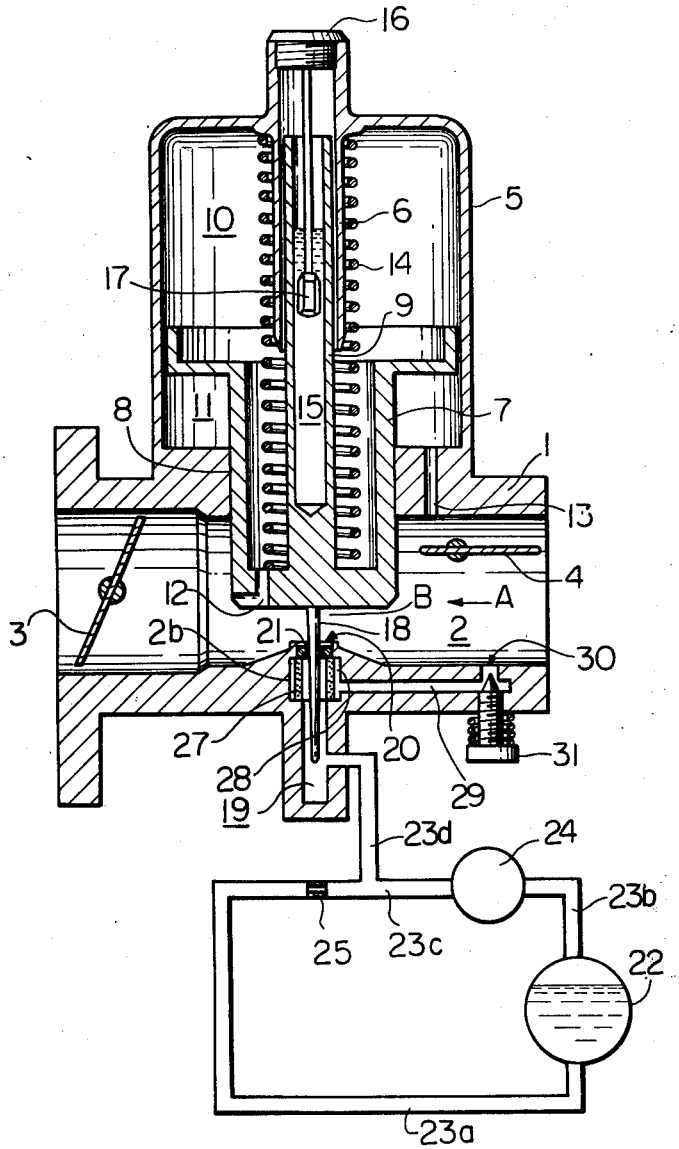
FIG. 2 is a cross-sectional side view of another embodiment according to the present invention.

FIG. 2 shows another embodiment of the present invention. Referring to FIG. 2, the fuel storing chamber 19 has on its upper portion an annular recess 26, and a hollow cylindrical bubble generating pipe 27 made of sintered metal is disposed in the annular recess 26. The inner diameter of the bubble generating pipe 27 is equal to that of the fuel storing chamber 19. On the other hand, an annular air chamber 28 is formed between the outer wall of the bubble generating pipe 27 and the inner wall of the annular recess 26 and is connected to an air bleed jet 30 via an air bleed passage 29. The opening area of the air bleed jet 30 is regulated by an idle adjuster screw 31 which serves to control an amount of bleed air at the time of the idling of the engine. The metering operation of the bleed air is carried out in the air bleed jet 30 and the bleed air thus metered is injected into the fuel storing chamber 19 in the form of fine bubbles due to the presence of the bubble generating pipe 27. Thus, the fine bubbles of air are mixed with the fuel in the fuel storing chamber 19 and, as a result, the density of the fuel in the fuel storing chamber 19 is reduced. Consequently, in order to inject into the intake passage 2 the same amount of fuel as that in a conventional carburetor, it is necessary to increase the annular opening area formed between the needle 18 and the jet 20 compared with the conventional case wherein the metering operation of the fuel containing no bubbles therein is effected. Therefore, in this case, it is possible to further increase the annular opening area 21 formed between the needle 18 and the jet 20 compared with that in the embodiment shown in FIG. 1.

Figure 3:
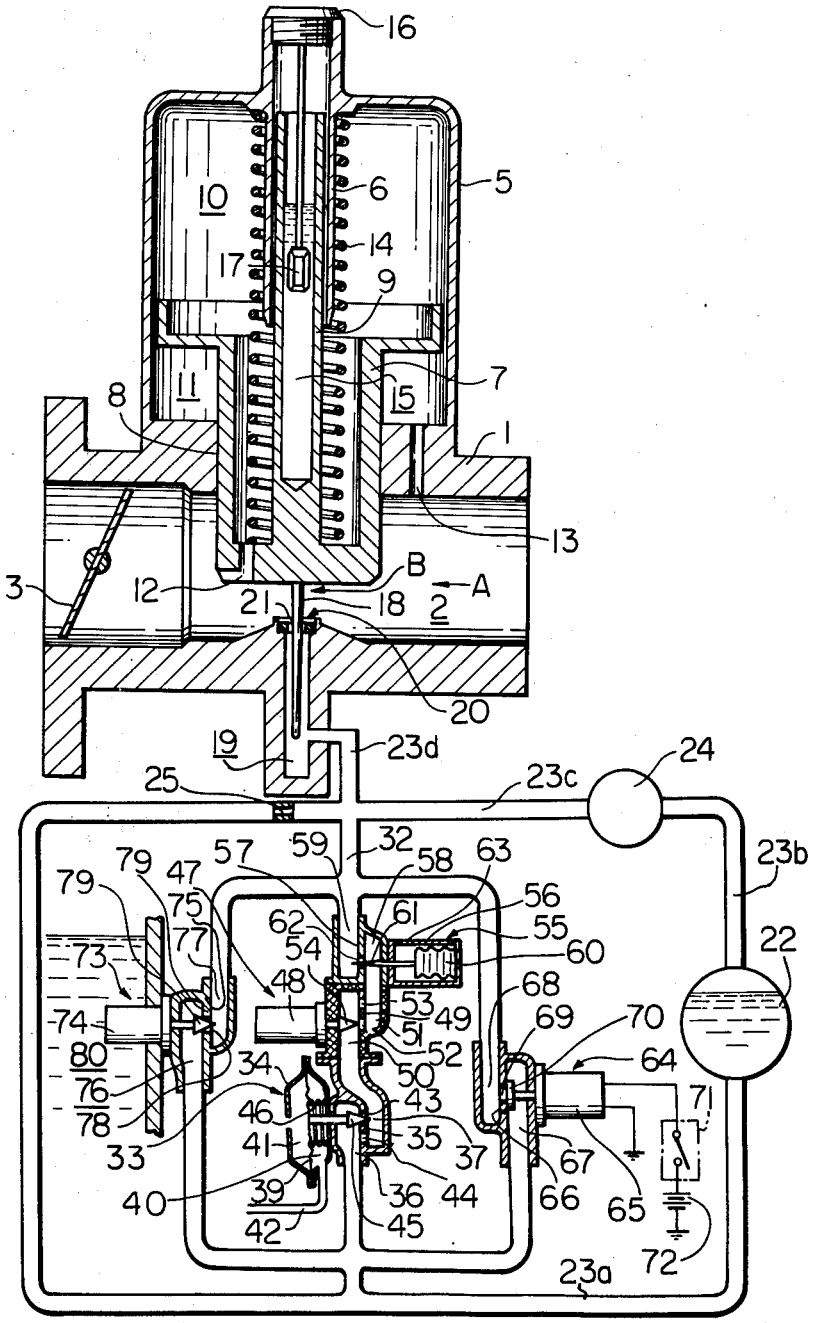
FIG. 3 is a cross-sectional side view of a further embodiment according to the present invention.

FIG. 3 shows a further embodiment of FIG. 1. Referring to FIG. 3, the fuel recirculating conduit 23c located downstream of the restricted opening 25 is connected to the fuel recirculating conduit 23a located upstream of the restricted opening 25 via a fuel recirculating bypass passage 32, and a number of flow control valve devices are disposed in the fuel recirculating bypass passage 32. These flow control valve devices serve to control the amount of the fuel flowing into the fuel recirculating conduit 23c located downstream of the restricted opening 25, thereby controlling the vacuum level in the fuel recirculating conduit 23c.

Figure 4:
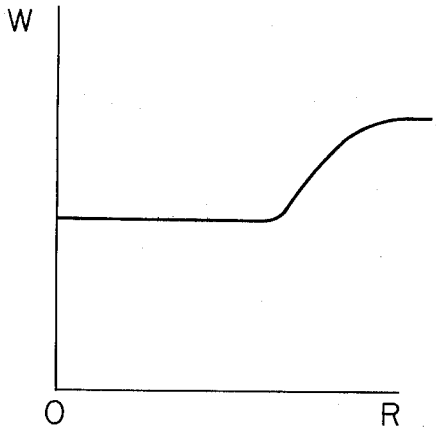
FIG. 4 is a graph showing the change in the amount of fuel caused by the first flow control valve device.

A first flow control valve device 33 comprises a diaphragm apparatus 34, an inflow chamber 36 and an outflow chamber 37 which are separated by a partition 35. The inflow chamber 36 is connected to the fuel recirculating conduit 23a located upstream of the restricted opening 25. The diaphragm apparatus 34 comprises a vacuum chamber 40 and an atmospheric chamber 41 separated by a diaphragm 39. The vacuum chamber 40 is connected to the intake passage 2 downstream of the throttle valve 3 via a vacuum conduit 42 (the connection is not shown). A valve port 43 and a restricted opening 44 are formed on the partition 35, and a fuel control valve 45 controlling the opening area of the valve port 43 is connected to the diaphragm 39. When the opening degree of the throttle valve 3 is relatively small, that is, when the engine is operating under a light load, since a relatively great vacuum is produced in the vacuum chamber 40, the fuel control valve 45 is maintained in a position where it closes the valve port 43, as is shown in FIG. 3 by the spring force of a compression spring 46. On the other hand, when the engine is operating under a heavy load, since a relatively small vacuum is produced in the vacuum chamber 40, the diaphragm 39 moves towards the right in FIG. 3 against the spring force of the compression spring 46. As a result of this, the valve port 43 is opened. As mentioned above, since the opening area of the valve port 43 is increased when the engine is operating under a heavy load, the amount of the fuel fed into the fuel recirculating conduit 23c is accordingly increased and, as a result, the vacuum level in the fuel recirculating conduit 23c is reduced. Thus the pressure difference between the vacuum in the venturi portion B and the vacuum in the fuel storing chamber 19 becomes large, whereby a relatively large amount of fuel is fed into the intake passage 2 from the jet 20. FIG. 4 shows a change in the amount of the fuel fed into the fuel recirculating conduit 23c, which is caused by the first flow control valve device 33. In FIG. 4, the ordinate indicates the amount of fuel W, and the abscissa indicates the load R of the engine.

Figure 5:
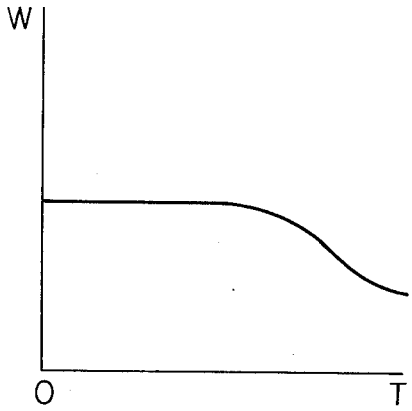
FIG. 5 is a graph showing the change in the amount of fuel caused by the second fuel control valve device.

A second flow control valve device 47 comprises a wax valve 48, an inflow chamber 50 and an outflow chamber 51 which are separated by a partition 49. The inflow chamber 50 is connected to the outflow chamber 37 of the first flow control valve device 33. A valve port 52 and a restricted opening 53 are formed on the partition 49, and the opening operation of the valve port 52 is controlled by a fuel control valve 54 of the wax valve 48. The wax valve 48 is exposed to the engine compartment of a vehicle (not shown) so as to be able to detect the temperature on the engine room. When the temperature in the engine room is relatively low, the fuel control valve 54 of the wax valve 48 is maintained in a position where the valve port 52 is open, as is shown in FIG. 3. On the other hand, when the temperature in the engine compartment becomes relatively high, the fuel control valve 54 moves towards the left in FIG. 3 and, as a result, the valve port 52 is closed. Consequently, when the temperature in the engine compartment becomes relatively high, since the opening area of the valve port 52 is reduced, the amount of fuel fed into the fuel recirculating conduit 23c is accordingly reduced. As a result of this, the vacuum level in the fuel recirculating conduit 23c is increased. Thus, the pressure difference between a vacuum in the venturi portion B and a vacuum in the fuel storing chamber 19 is reduced and, as a result, the amount of fuel injected into the intake passage 2 from the jet 20 is reduced. FIG. 5 shows a change in an amount of fuel fed into the fuel recirculating conduit 23c, which is caused by the second flow control valve device 47. In FIG. 5, the ordinate indicates the amount of fuel W, and the abscissa indicates the temperature T in the engine compartment.

Figure 6:
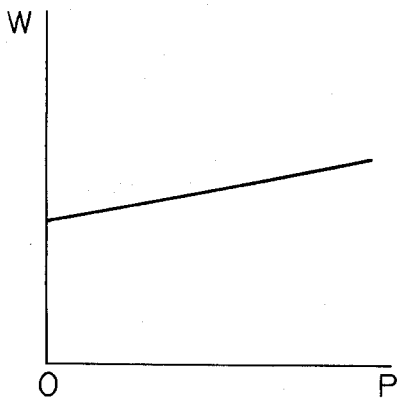
FIG. 6 is a graph showing the change in the amount of fuel caused by the third flow control valve device.

A third flow control valve device 55 comprises a bellows apparatus 56, an inflow chamber 58 and an outflow chamber 59 which are separated by a partition 57. The inflow chamber 58 is connected to the outflow chamber 51 of the second flow control valve device 47, and the outflow chamber 59 is connected to the fuel recirculating conduit 23c. The bellows apparatus 56 comprises a bellows 60 and a needle 61 fixed onto the bellows 60. This needle 61 passes through a jet 62 formed on the partition 57. The pressure in the bellows 60 is maintained at normal atmospheric pressure and, on the other hand, the inside of the housing of the bellows apparatus 56 is connected to the atmosphere via an opening 63. Consequently, if the engine is operating under a relatively low atmospheric pressure as in the case wherein a vehicle is driven at high elevations the bellows 60 extends outwardly. As is shown in FIG. 3, the needle 61 has a longitudinal cross-sectional area which gradually decreases towards the front end of the needle 61. Therefore, when the bellows 60 extends outwardly as mentioned above, the opening area of the jet 62 is reduced and, as a result, the amount of fuel fed into the fuel recirculating conduit 23c is accordingly reduced. Thus, the vacuum level in the fuel recirculating conduit 23c is increased. As a result of this, since the pressure difference between a vacuum in the venturi portion B and a vacuum in the fuel storing chamber 19 is reduced, the amount of the fuel injected into the intake passage 2 from the jet 20 is decreased. FIG. 6 shows a change in the amount of fuel fed into the fuel recirculating conduit 23c, which is caused by the third flow control valve device 55. In FIG. 6, the ordinate indicates the amount of fuel W, and the abscissa indicates the atmospheric pressure P.

A fourth flow control valve device 64 comprises an electromagnetic apparatus 65, an inflow chamber 67 and an outflow chamber 68 which are separated by a partition 66. The inflow chamber 67 is connected to the fuel recirculating conduit 23a located upstream of the restricted opening 25 and, on the other hand, the outflow chamber 68 is connected to the fuel recirculating conduit 23c. A valve port 69 is formed on the partition 66, and the opening operation of the valve port 69 is controlled by a fuel control valve 70 of the electromagnetic apparatus 65. The solenoid (not shown) of the electromagnetic valve 65 is connected to a power source 72 via a switch 71. This switch 71 is associated with the ingnition switch (not shown) of the engine, and is turned to the ON condition when the ignition switch is changed to a position in which the cell motor (not shown) is driven for starting the engine. When the switch 71 is turned to the ON condition, the solenoid of the electromagnetic apparatus 65 is energized. As a result of this, the fuel control valve 70 moves towards the right in FIG. 3, whereby the valve port 69 is opened. The opening area of the valve port 69, is considerably larger than that of the restricted opening 24. Thus, at the time of the starting operation of the engine, the pressure in the fuel recirculating conduit 23c is equal to the atmospheric pressure and, as a result, the pressure difference between a vacuum in the venturi portion B and a pressure in the fuel storing chamber 19 becomes extremely large. As a result of this, a large amount of fuel is injected into the intake passage 2 from the jet 20.

Figure 7:
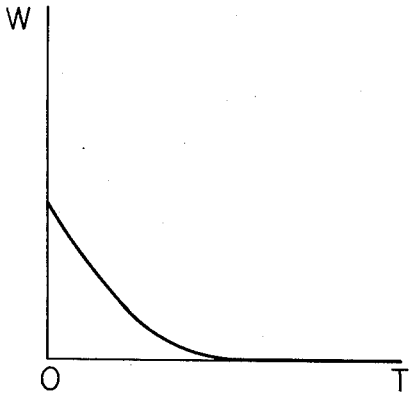
FIG. 7 is a graph showing the change in the amount of fuel caused by the fifth flow control valve device.

A fifth flow control valve device 73 comprises a wax valve 74, an inflow chamber 76 and an outflow chamber 77 which are separated by a partition 75. The inflow chamber 76 is connected to the fuel recirculating conduit 23a located upstream of the restricted opening 25 and, on the other hand, the outflow chamber 77 is connected to the fuel recirculating conduit 23c. A valve port 78 is formed on the partition 75, and the opening operation of the valve port 78 is controlled by a fuel control valve 79 of the wax valve 74. The wax valve 74 is dipped in, for example, the cooling water 80 of the engine so as to be able to detect the temperature of the cooling water 80. When the temperature of the cooling water 80 is relatively low, the fuel control valve 79 is maintained at a position where the valve port 78 is open. As a result of this, since the pressure in the fuel recirculating conduit 23c is equal to approximately atmospheric pressure, a large amount of fuel is injected into the intake passage 2 from the jet 20. When the temperature of the cooling water is increased, the fuel control valve 79 moves towards the left in FIG. 3 and, thus, the opening area of the valve port 78 is gradually reduced. As a result of this, the amount of fuel fed into the fuel recirculating conduit 23c is gradually reduced and, thus, the vacuum level in the the fuel recirculating conduit 23c is gradually increased, whereby the amount of the fuel injected into the intake passage 2 is gradually reduced. When the temperature of the cooling water is increased beyond a predetermined level, the valve port 78 is closed as is shown in FIG. 3. FIG. 7 shows a change in the amount of fuel fed into the fuel recirculating conduit 23c, which is caused by the fifth flow control valve device 73. In FIG. 7, the ordinate indicates the amount of fuel W, and the abscissa indicates the temperature T of the cooling water.

As is hereinbefore mentioned, by the provision of the five flow control valve devices 33, 47, 55, 64 and 73, the amount of the fuel injected into the intake passage 2 can be greatly increased particularly at the time of the starting operation of the engine and can be increased in accordance with the level of the load on the engine when the engine is operating under a heavy load. In addition, the amount of the fuel injected into the intake passage 2 can be reduced in accordance with an increase in the temperature of the cooling water at the time of the warm-up of the engine. Furthermore, the amount of the fuel injected into the intake passage 2 can be reduced in accordance with a decrease in the atmospheric pressure when a vehicle is driven at high elevations. In addition, the amount of fuel injected into the intake passage 2 can be reduced in accordance with an increase in the temperature in the engine compartment when the temperature in the engine room is relatively high.

In the embodiment shown in FIG. 3, the carburetor may be provided with an air bleed system having the bubble generating pipe 27 as shown in FIG. 2. In addition, instead of using the flow control valve devices 33, 47, 55, 64 and 73, flow control valve devices of any other type can be used.

According to the present invention, by producing a vacuum in the fuel storing chamber, it is possible to increase the annular opening area formed between the needle and the jet compared with that in a conventional carburetor. As a result of this, the irregularities in the accuracy of the size of the manufactured jet and needle, and in the wear of the jet and the needle, have scarcely any influence on the amount of fuel injected from the jet. In addition, the amount of fuel injected from the jet becomes unresponsive to a change in the temperature of the fuel. Consequently, the metering accuracy of the fuel is greatly improved. Furthermore, since it is possible to further increased the annular open area formed between the needle and the jet by providing an air bleed system containing a bubble generating pipe therein, the metering accuracy of the fuel is further improved. In addition, the amount of fuel fed into the cylinder can be increased at the time of the starting operation and the warm-up of the engine, and when the engine is operating under a heavy load, while the amount of fuel fed into the cylinder can be reduced when the temperature in the engine compartment becomes relatively high and when a vehicle is driven at high elevations. Particularly in the embodiment shown in FIG. 3, since there is no need of providing a choke mechanism, the metering operation of fuel can be accurately carried out before the completion of the warm-up of the engine. As a result of this, it is possible to reduce the amount of harmful HC and CO components in the exhaust gas and to reduce the fuel consumption at the time of the warm-up of the engine.

While the invention has been described by referring to specific embodiments chosen for purposes of illustration, it should be apparent that numerous modifications could be made thereto by those skilled in the art without departing from the spirit and scope of the invention.

What is claimed is:

1. A variable venturi type carburetor of an internal combustion engine, comprising:

a housing;

a bore extending through said housing and having an inner wall defining an intake passage;

a suction piston movably mounted in said housing and having a bottom end face projecting into said intake passage, said bottom end face of said suction piston and said inner wall of said intake passage defining a venturi, said suction piston moving up and down in response to a change in the vacuum produced in said intake passage downstream of said venturi for maintaining the velocity of air flowing into said venturi at a constant value;

a jet disposed on the inner wall of said intake passage at a position facing said bottom end face of said suction piston;

a needle fixed onto said bottom end face of said suction piston and entering into said jet, said jet and said needle defining an annular opening throough which fuel is injected into said intake passage;

a fuel reservoir;

a fuel recirculating pump having a suction side;

a fuel recirculating passage communicating said fuel reservoir with the suction side of said fuel recirculating pump;

a restricted opening disposed in said fuel recirculating passage for forming a vacuum zone in said fuel recirculating passage located between said restricted opening and the suction side of said fuel recirculating pump, and;

a fuel supply passage communicating said vacuum zone with said jet.

2. A variable venturi type carburetor as claimed in claim 1, wherein said carburetor further comprises an air bleed passage communicating said fuel supply passage with the atmosphere, a bubble generating pipe made of sintered metal being disposed in said fuel supply passage at a position in which said air bleed passage opens into said fuel supply passage for creating fine bubbles of air in the fuel contained in said fuel supply passage.

3. A variable venturi type carburetor as claimed in claim 1, wherein said carburetor further comprises a fuel recirculating bypass passage communicating said vacuum zone with said fuel reservoir, and valve means disposed in said fuel recirculating bypass passage for controlling the amount of fuel fed into said vacuum zone and controlling the vacuum level in said fuel supply passage.

4. A variable venturi type carburetor as claimed in claim 3, wherein said valve means comprises a valve device for increasing the amount of fuel fed into said vacuum zone in accordance with the load level of the engine.

5. A variable venturi type carburetor as claimed in claim 4, wherein said valve device comprises a vacuum operated diaphragm apparatus, a restricted opening always permitting the passage of fuel, a valve port and a fuel control valve connected to said diaphragm apparatus for controlling the amount of fuel flowing in said valve port in accordance with a change in vacuum in said intake passage.

6. A variable venturi type carburetor as claimed in claim 3, in which the engine is disposed in the engine compartment of a vehicle, wherein said valve means comprises a valve device for reducing the amount of fuel fed into said vacuum zone in accordance with an increase in the temperature in the engine compartment.

7. A variable venturi type carburetor as claimed in claim 6, wherein said valve device comprises a restricted opening always permitting the passage of fuel, a valve port and a wax valve having a fuel control valve for controlling the amount of fuel flowing in said valve port in accordance with a change in the temperature of said engine compartment.

8. A variable venturi type carburetor as claimed in claim 3, wherein said valve means comprises a valve device for reducing the amount of fuel fed into said vacuum zone in accordance with a decrease in the atmospheric pressure.

9. A variable venturi type carburetor as claimed in claim 8, wherein said valve device comprises a bellows device, a valve port and a needle connected to said bellow device for controlling the amount of fuel flowing in said valve port in accordance with a change in the atmospheric pressure.

10. A variable venturi type carburetor as claimed in claim 3, wherein said valve means comprises a valve device for permitting the passage of fuel fed into said vacuum zone at the time of the starting operation of the engine.

11. A variable venturi type carburetor as claimed in claim 10, wherein said valve device comprises a valve port, a detecting means providing a control signal indicating the starting operation of the engine, and an electromagnetic apparatus having a fuel control valve for permitting the passage of fuel in response to said control signal.

12. A variable venturi type carburetor as claimed in claim 3, wherein said valve means comprises a valve device for reducing the amount of fuel fed into said vacuum zone after the completion of the warm-up of the engine.

13. A variable venturi type carburetor as claimed in claim 12, wherein said valve device comprises a valve port and a wax valve having a fuel control valve for controlling the amount of fuel in accordance with a change in the temperature of the cooling water.

14. A variable venturi type carburetor as claimed in claim 3, wherein said valve means comprises a first valve device for increasing the amount of fuel fed into said vacuum zone in accordance with the level of load of the engine, a second valve device for reducing the amount of fuel fed into said vacuum zone in accordance with an increase in the temperature in the engine compartment, a third valve device for reducing the amount of fuel fed into said vacuum zone in accordance with a decrease in the atmospheric pressure, a fourth valve device for permitting the passage of the fuel fed into said vacuum zone at the time of the starting operation of the engine, and a fifth valve device for reducing the amount of fuel fed into said vacuum zone after the completion of the warm-up of the engine.

15. A variable venturi type carburetor as claimed in claim 3, wherein said carburetor further comprises an air bleed passage communicating said fuel supply passage with the atmosphere, a bubble generating pipe made of sintered metal being disposed in said fuel supply passage at a position in which said air bleed passage opens into said fuel supply passage for creating fine bubbles of air in the fuel contained in said fuel supply passage.

16. A variable venturi type carburetor as claimed in claim 1, wherein said fuel recirculating pump is driven by an electrical motor always rotating at a constant speed.

17. A variable venturi type carburetor as claimed in claim 1, wherein said fuel recirculating pump is driven by an engine, said vacuum zone being connected to said fuel recirculating passage located between said fuel reservoir with said restricted opening via a bypass, a pressure regulating valve being disposed in said bypass for maintaining the fuel in said vacuum zone at a constant vacuum level.

* * * * *